US005863149A

United States Patent [19]

Gustin

[11] Patent Number: 5,863,149

[45] Date of Patent: Jan. 26, 1999

[54] MATERIAL FLOW MANAGEMENT MEANS FOR PAVING MACHINES

[75] Inventor: Craig R. Gustin, Rochelle, Ill.

[73] Assignee: Caterpillar Paving Products, Inc., Minneapolis, Minn.

[21] Appl. No.: 819,891

[22] Filed: Mar. 18, 1997

[51] Int. Cl.[6] ..... E01C 9/10; E01C 19/12

[52] U.S. Cl. ..... 404/104; 404/101

[58] Field of Search ..... 404/101, 104, 404/105

[56] References Cited

U.S. PATENT DOCUMENTS

| | | | |
|---|---|---|---|
| 3,288,041 | 11/1966 | Layton | 404/108 |
| 3,362,306 | 1/1968 | Frantz | 222/160 |
| 3,453,939 | 7/1969 | Pollitz | 404/84.05 |
| 4,272,213 | 6/1981 | McGovarin | 404/118 |
| 4,379,653 | 4/1983 | Brown | 404/118 |
| 4,688,965 | 8/1987 | Smith et al. | 404/75 |
| 4,702,642 | 10/1987 | Musil | 404/118 |
| 4,863,310 | 9/1989 | Reed | 404/104 |
| 5,203,642 | 4/1993 | Heller et al. | 404/118 |
| 5,215,404 | 6/1993 | Raymond | 404/118 |
| 5,344,254 | 9/1994 | Sartain | 404/104 |
| 5,401,115 | 3/1995 | Musil et al. | 404/72 |
| 5,405,214 | 4/1995 | Campbell | 404/80 |
| 5,452,966 | 9/1995 | Swisher, Jr. | 404/72 |
| 5,470,175 | 11/1995 | Jensen et al. | 404/72 |
| 5,529,434 | 6/1996 | Swisher, Jr. | 404/108 |
| 5,533,829 | 7/1996 | Campbell | 404/81 |

*Primary Examiner*—Tamara L. Graysay
*Assistant Examiner*—Sunil Singh
*Attorney, Agent, or Firm*—Lawhorn, Simpson & Polsley

[57] ABSTRACT

Material flow management apparatus for a paving machine having a screed assembly, including at least one pivotally mounted flow control gate operably connected to a selectively controllable actuator for actuating the flow control gate to a flow preventing position and flow permitting positions, the flow control gate mounted immediately adjacent the outer edge of the main body of the screed assembly to variably control the volumetric flow of paving aggregate from the main material reservoir preceding the screed main body and ensure a suitable volumetric material supply to the secondary material reservoir preceding the variably extensible screed extension body.

24 Claims, 1 Drawing Sheet

MATERIAL FLOW MANAGEMENT MEANS FOR PAVING MACHINES

TECHNICAL FIELD

This invention relates to paving apparatus and more particularly to apparatus for management of the material flow in paving machines.

BACKGROUND ART

Paving machines are commonly employed in the laying of bituminous roadway mat. The typical paving machine employs a "floating screed" for spreading and compressing the bituminous material to form a smooth surfaced roadway mat. While in the past it has been common to use a floating screed of fixed width, for example, on the order of eight feet or ten feet in width, it has been discovered that the efficiency of the paving machine can be increased and the number of trips required to generate a road surface can be decreased by employing a floating screed having an operator selectable width. This may be accomplished by providing a series of extensions which may be affixed to the main body of the floating screed to a predetermined fixed width. However, a more advantageous arrangement of the floating screed includes one, or more typically two, screed extensions which are slidingly attached to the main body of the floating screed. These screed extensions are typically connected to a linear power source such as a bi-directional hydraulic cylinder or other similar activator, which is selectively operable in response to controls disposed at the operator's control station. This permits the operator to control the position of the screed extensions in response to changing requirements as the paving machine progresses. For example, this permits the screed operator to accommodate obstacles in the path of the paving machine such as sewer drains and manhole covers, and also to permit overwidth paving of the road surface to accommodate driveway entrances and other similar areas where overwidth paving of the roadway mat is desired.

The floating screed type paving machine is typically a self-propelled tractor unit providing a storage means for receiving and containing a discreet quantity of loose bituminous aggregate and a material flow means for conveying the bituminous aggregate to the roadbed where the loose bituminous aggregate is then displaced laterally in front of the floating screed. As the paving machine progresses along the roadbed, the floating screed engages the loose bituminous aggregate, plowing under and compressing the bituminous aggregate into the desired roadway mat. It is common to provide endgates on the outer, distal ends of the screed extensions to ensure that the loose bituminous aggregate disposed in front of the screed extensions is not merely shunted aside beyond the width of the floating screed. The means most commonly used for providing the lateral disposition of the loose bituminous aggregate is a flighted auger providing two oppositely directed flights from the centerline of the paving machine to provide disposition of an equal amount of bituminous aggregate toward the outer edges of the floating screed. While this means has proved to be generally satisfactory, a difficulty exists in ensuring that the appropriate desired amount of loose bituminous aggregate is provided to the screed extensions. This problem is exacerbated by the fact that paving machines are often operated under less than ideal conditions, and it is often necessary to operate one screed extension at a different width than the other screed extension as obstacles are passed or width changes in the roadway mat must be accommodated as the paving machine moves forward. It is necessary for the screed operator to ensure that a suitable proportion of loose bituminous aggregate is available to ensure satisfactory completion of the roadway mat in connection with the furthest extended screed extension, and this causes an undesirable accumulation of bituminous aggregate in front of the less far extended screed extension, due to the fact that there is a reduced amount of area to be covered under that floating screed extension. Furthermore, even where the screed extensions are extended to similar widths, it is undesirably difficult for the screed operator to assure that the desired amount of loose bituminous aggregate is provided for the floating screed. In the operation of current paving machines, the screed operator must cause a suitable flow of loose bituminous aggregate to the auger to ensure that a sufficient amount of aggregate will cascade across the floating screed to reach and fill the area in front of the floating screed to the minimum requisite depth required for the pavement mat. However, the screed operator must be possessed of a substantial amount of skill and expertise to accomplish this result due to the fact that the primary means of controlling the amount of aggregate available to the floating screed is in the conveyance means from the tractor unit of the paving machine.

Therefore, it is an object of the present invention to provide an improved material flow management system for a paving machine.

It is another object of the present invention to provide such a material flow management system as will provide improved control of the aggregate available to the floating screed.

It is a further object of the present invention to provide such a material flow management system as will provide improved control of the material flow to the screed extension.

It is yet another object of the present invention to provide such a material flow management system as will be selectively controllable by the screed operator.

It is yet a further object of the present invention to provide such a material flow management system as will relatively inexpensive to manufacture.

It is another object of the present invention to provide such a material flow management system as will be readily applied to paving machines and such as will not require substantial modification of a paving machine.

It is yet a further object of the present invention to provide such a material flow management system as will be inexpensive to maintain and will be durable.

It is yet a further object of the present invention to provide such a material flow management system as will provide an intermediate boundary to aid a screed operator in controlling the disposition of loose bituminous aggregate in front of the floating screed of a paving machine.

SUMMARY OF THE INVENTION

The subject invention is comprised of a selectively controllable and operator positionable flow gate disposed at each distal end of the main screed of a floating screed for permitting selective operator controlled dispersion of bituminous aggregate from the lateral dispersal means of a paving machine to permit a selectively controlled flow from the main screed to a screed extension of the floating screed unit of a paving machine.

DESCRIPTION OF THE PREFERRED EMBODIMENT

Figure 1:
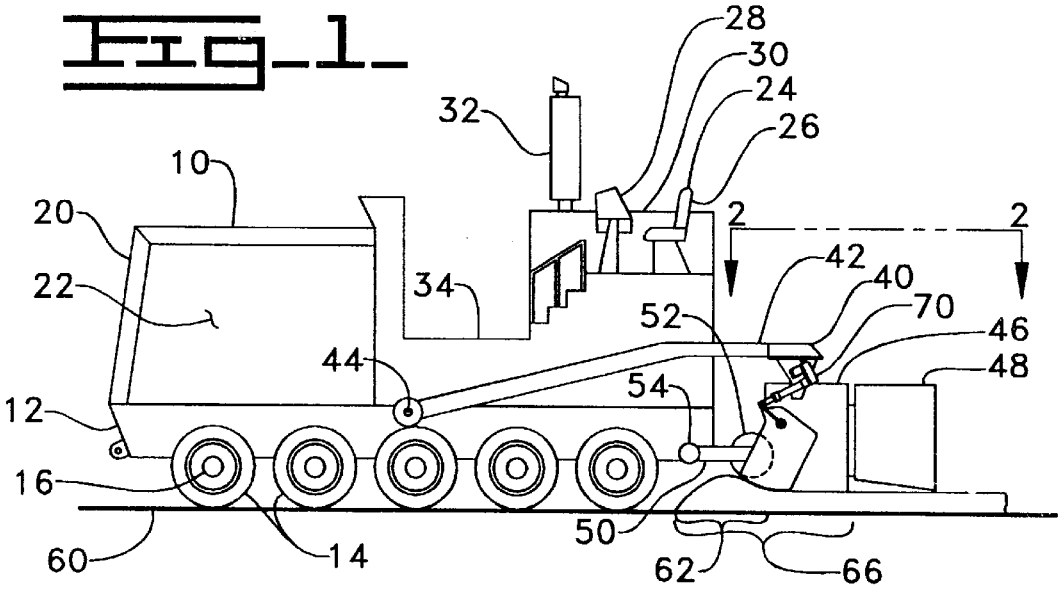
FIG. 1 shows a paving machine including a material flow management apparatus according to the subject invention.

A paving machine or apparatus including the present invention is shown generally in FIG. 1 and referred to by the reference number 10.

The paving machine 10 includes a frame 12 which is supported by and transported upon a plurality of transport wheels 14 oppositely disposed on axles 16 which extend underneath the frame 12 transverse to the direction of motion of the paving machine 10. A hopper 20 is disposed on the forward portion of the frame 12. The hopper 20 includes sides 22 extending vertically from the frame 12 so that the hopper 20 can receive discreet quantities of fume-emitting bituminous aggregate material from transport vehicles such as dump trucks, and retain that bituminous aggregate material in the hopper 20 pending its disposition on the surface to be paved. Towards the rear of the frame 12, an operator station 24 is provided so that an operator seated at the operator's chair 26 can control the operation of the paver by way of the controls provided in the control panel 28. Also disposed toward the rear of the frame 12 is an engine housing 30 on which is provided an exhaust stack 32 for exhausting the combustion by-products of the prime mover contained in the engine housing 30. Between the hopper 20 and the engine housing 30 a walkway area 34 is provided to permit access by the paving machine operator or members of the paving crew from side to side of the paving machine or to the engine housing 30 or other machinery and components disposed or mounted upon the paver 10.

A floating screed sub-assembly 40 is pivotally connected to the frame 12 by two screed support arms 42. The screed support arms 42 are substantially parallel and horizontal, being disposed along the frame 12 and pivotally connected to the frame 12 at the arm pivot 44 which has a horizontal axis transverse to the direction of travel of the paver 10, thus permitting vertical movement of the screed assembly 40. Typically, as is known to those skilled in the art, a means is provided for controlling and limiting the vertical movement of the screed sub-assembly 40, and as these components do not comprise any part of the subject invention, they are not shown or disclosed herein. The floating screed sub-assembly 40 as shown is comprised of a main screed body 46 and laterally positionable screed extensions 48 which are disposed behind and parallel to the main screed body 46.

An aggregate disposition means 50 is also provided. This disposition means 50 includes a flighted auger 52 disposed adjacent the rear of the frame 12 in a horizontal and axially transverse position with respect to the direction of travel of the paver 10. Also shown in a representational manner is an auger support means 54 for controlling the position of the auger 52.

Those skilled in the art will understand that the paver 10 and components thereof, including the floating screed sub-assembly 40 and the aggregate disposition means 50, as described herein, are exemplary only, and that the drawing figures are not scale representations of any particular paver apparatus 10. The paver 10 as described herein is not intended to be limiting but rather to be illustrative of apparatus and applications in which the present invention is preferably to be employed. For example, although the paver 10 is described as a wheel-type paver, the subject invention may be equally suitably employed on a track-type paver.

Figure 2:
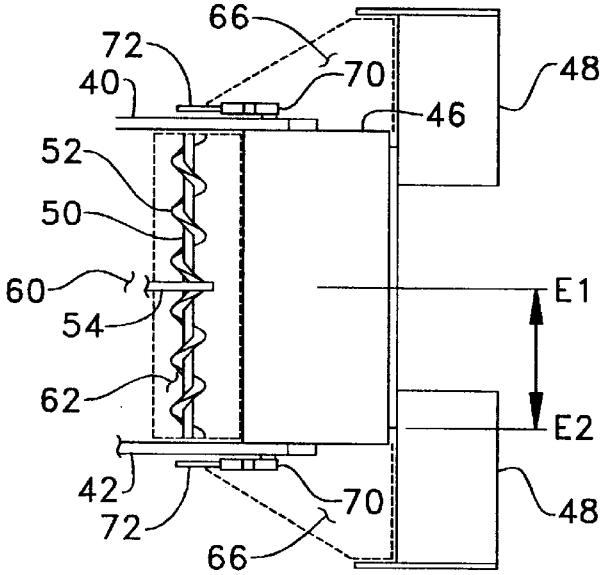
FIG. 2 shows a partial top view of the paving machine including the material flow management apparatus according to the subject invention as taken along line 2—2 of FIG. 1.

The transport wheels 14 of the paver 10 operate on and along a prepared roadbed surface 60 with the hopper 20 facing the direction of travel so as to receive and contain a portion of aggregate material. A quantity of aggregate material is deposited at a selected volumetric flow rate from the paver 10 in a main material reservoir 62 preceding the main screed body 46, as shown in FIG. 2. The aggregate disposition means 50 operates on the deposited aggregate material to move a portion of the material from the main material reservoir 62 to a secondary material reservoir 66 preceding the screed extensions 48.

Figure 3:
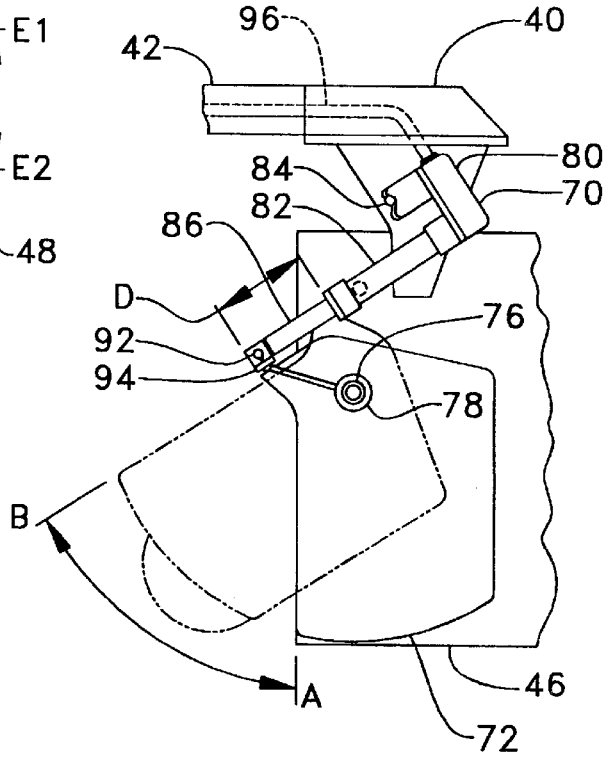
FIG. 3 shows an enlarged partial side view of the paving machine and the material flow management apparatus according to the subject invention.

As shown in FIGS. 1 and 3, the paver 10 further includes a material flow management means 70 disposed on the main screed body 46. The material flow management means 70 includes a flow control gate 72 pivotally mounted on a flow gate spindle 76 which are substantially horizontal, extending transversely from the screed main body 46 at the outer end thereof. The flow gate spindle 76 extends through a flow gate bearing 78 disposed adjacent the upper end of the flow control gate 72 for permitting a rotational pivotal mounting of the flow gate 72 with respect to the main screed body 46.

The material flow management means 70 is also provided with a flow gate actuator means 80. The flow gate actuator means 80 includes an actuator body 82 pivotally mounted by a first actuator means mounting pin 84 to a screed arm 42 for permitting a relative rotational motion between the actuator means 80 and the screed arm 42. An actuator plunger 86 operates within the plunger body 82 in a linear reciprocating manner to permit a greater or lesser extension of the actuator means 80. The actuator plunger 86 is connected by a second actuator means connecting pin 92 to a flow gate yoke 94 at an upper corner of the flow gate 72, disposed at a distance from the flow gate spindle 76. At least one or more actuator control lines, one of which is shown at 96 are connected to a control means (not shown) for selectively controlling the operation of the flow gate actuator means 80. It is believed that those skilled in the art will appreciate the various types of typical control means which may be suitable for application to the material flow management means 70. For example, the flow gate actuator means 80 may be a hydraulic cylinder operated in response to a controlled flow of hydraulic fluid through the control line 96, or alternatively may be an electrically operated motor responsive to electrical signals transmitted through control line 96.

The actuator plunger 86 operates reciprocally with the actuator body 82 through a distance D between a maximum extension and a minimum extension of the actuator means 80. As shown in FIG. 3, when the actuator plunger 86 is at its maximum extension, the flow control gate 72 is actuated to the fully open position A, and is disposed immediately adjacent to the main screed body 46, and when the actuator plunger 86 is at its minimum extension, the flow control gate 72 is moved to the fully closed position B. In the fully closed position B, at least a portion of the flow control gate 72 extends in front of the main screed body 46, to prevent a flow of aggregate material from the main material reservoir 62 to the secondary material reservoir 66 adjacent the main screed body 46.

In operation, material is transported to and deposited in the main material reservoir 62, as shown in FIG. 2, by the paver 10 while the paver 10 is operated along the roadbed surface 60 for laying an aggregate road surface. The position of each screed extension 48 is independently variable, and is selected by the paver operator to a position between the minimum extension E1 to the maximum extension E2 thereof. The area of each secondary material reservoir 66 is that area adjacent the main material reservoir 62 and the main screed body 46, and preceding the extended portion of the screed extension 48.

When the screed extension 48 is operated to the minimum extension E1, the secondary material reservoir 66 is at its minimum area of coverage. Therefor, the flow gate actuator means 80 is operated to the minimum extension when the screed extension is at the minimum extension position E1. This pivots the flow control gate 72 to the fully extended closed position B to prevent flow from the main material reservoir 62 to the secondary material reservoir 66.

On the other hand, when the screed extension 48 is actuated to the fully extended position E2, the flow control gate actuator means 80 is actuated to the fully extended position of the actuator plunger 86, driving the flow control gate 72 to the fully open position A, and permitting the maximum volumetric flow of material from the main material reservoir 62 to the secondary material reservoir 66.

At intermediate positions of the screed extension 48 between the fully retracted position E1 and the fully extended position E2, the flow gate actuator means 80 is actuated to an intermediate position to permit a volumetric flow rate of material corresponding to the relative width to be covered by the screed extension 48. Furthermore, where there are variations in the roadbed surface 60 requiring a reduction in material provided to the screed extension 48, the flow control gate 72 can be actuated by the actuator means 80 to an intermediate position which provides relatively less material to the secondary material reservoir 66 from the main material reservoir 62, assuring that the desired volumetric rate of material flow is achieved.

Preferably, the components of the material flow management means 70 will be formed from metals such as steel or other durable alloys to ensure that the material flow management means 70 is sufficiently durable and resistant to wear and abrasion from the material used in the paving process, and also to assure that the material flow management means 70 is not adversely affected by the relatively higher temperatures at which such paving materials are typically maintained.

Several advantages inherent in the material management means 70 according to the present invention are readily apparent. First, the material flow management means 70 assures that the proper volumetric flow rate of material is attained from the main material reservoir 62 to the secondary material reservoir 66. Second, the material flow management means 70 is independently operable to permit the independent control of the screed extension 48 so as to permit the paver 10 to perform asymmetrical paving operations, with one screed extension 48 at an extension which is at variance with the other screed extension 48. Third, the material flow management means 70 ensures that excessive material is not provided to the secondary material reservoir 66, thus avoiding unnecessary cleanup or waste of material which might otherwise be pushed aside and left unused by the paver 10. Fourth, the material flow management means 70 is easy to operate and inexpensive to manufacture, install, and maintain. Therefore, it can be seen that the present invention presents substantial improvements over the prior art. These and other advantages will be readily apparent to those skilled in the art.

Modifications to the preferred embodiment of the subject invention will be apparent to those skilled in the art within the scope of the claims that follow:

What is claimed is:

1. A material flow management means for a paver having a floating screed subassembly including a main screed body, the material flow management means comprised of:

said floating screed subassembly having at least one screed extension;

a flow control gate pivotally mounted to said main screed body; and an actuator means for selectably controlling and positioning said flow control gate for controlling a volumetric flow rate of material to said screed extension.

2. The material flow management means as set forth in claim 1 wherein said flow control gate is pivotally mounted on a flow gate spindle on an end of said main screed body.

3. The material flow management means as set forth in claim 2 wherein said flow control gate is pivotally operable to a flow-permitting open position (A).

4. The material flow management means as set forth in claim 3 wherein said flow control gate is pivotally operable to a flow-preventing closed position (B).

5. The material flow management means as set forth in claim 4 wherein said flow control gate is pivotally operable to an intermediate volumetric flow position.

6. The material flow management means as set forth in claim 5 wherein said flow gate actuator means further includes a first actuator means connecting pin for pivotally connecting said flow gate actuator means to said floating screed subassembly.

7. The material flow management means as set forth in claim 6 wherein said flow gate actuator means further includes a second actuator means connecting pin for pivotally connecting said flow gate actuator means to said flow control gate.

8. The material flow management means as set forth in claim 7 wherein said flow gate actuator means further includes an actuator control line for transmitting a control signal to the flow gate actuator means to selectively control actuation thereof.

9. The material flow management means as set forth in claim 8 wherein said flow gate actuator means further includes an actuator body connected to said first actuator means connecting pin.

10. The material flow management means as set forth in claim 9 wherein said flow gate actuator means further includes an actuator plunger connected to said second actuator means connecting pin.

11. The material flow management means as set forth in claim 10 wherein said actuator plunger operates reciprocally within said actuator body between a maximum extension and a minimum extension of the flow gate actuator means.

12. A paver for laying on a roadbed an aggregate road surface, the paver comprised of:

a frame for supporting said paver;

a floating screed subassembly operably attached to said frame, said floating screed subassembly including a main screed body defining a main material reservoir adjacent said main screed body, and at least one screed extension defining a secondary material reservoir;

an aggregate disposition means for placing aggregate paving material in said main material reservoir; and a material flow management means for selectably controlling material flow from said main material reservoir to said secondary material reservoir.

13. The paver as set forth in claim 12 wherein said material flow management means further includes a flow control gate pivotally mounted to said main screed body.

14. The material flow management means as set forth in claim 13 wherein said flow control gate is pivotally mounted on a flow gate spindle on an end of said main screed body.

15. The material flow management means as set forth in claim 14 wherein said flow control gate is pivotally operable to a flow-permitting open position (A) to permit a flow of aggregate material from said main material reservoir to said secondary material reservoir.

16. The material flow management means as set forth in claim 15 wherein said flow control gate is pivotally operable to a flow-preventing closed position (B) to prevent a flow of aggregate material from said main material reservoir to said secondary material reservoir.

17. The material flow management means as set forth in claim 16 wherein said flow control gate is pivotally operable to an intermediate volumetric flow position to permit a flow of an intermediate volume of aggregate material from said main material reservoir to said secondary material reservoir.

18. The material flow management means as set forth in claim 17 further including an actuator means for selectably controlling and positioning said flow control gate.

19. The material flow management means as set forth in claim 18 wherein said flow gate actuator means further includes a first actuator means connecting pin for pivotally connecting said flow gate actuator means to said floating screed subassembly.

20. The material flow management means as set forth in claim 19 wherein said flow gate actuator means further includes a second actuator means connecting pin for pivotally connecting said flow gate actuator means to said flow control gate.

21. The material flow management means as set forth in claim 20 wherein said flow gate actuator means further includes an actuator control line for transmitting a control signal to the flow gate actuator means to selectively control actuation thereof.

22. The material flow management means as set forth in claim 21 wherein said flow gate actuator means further includes an actuator body connected to said first actuator means connecting pin.

23. The material flow management means as set forth in claim 22 wherein said flow gate actuator means further includes an actuator plunger connected to said second actuator means connecting pin.

24. The material flow management means as set forth in claim 23 wherein said actuator plunger operates reciprocally within said actuator body between a maximum extension and a minimum extension of the flow gate actuator means.

* * * * *